US005723267A

United States Patent [19]

Ito

[11] Patent Number: 5,723,267

[45] Date of Patent: Mar. 3, 1998

[54] SILVER HALIDE PHOTOGRAPHIC MATERIAL AND THE METHOD OF PROCESSING THE SAME

[75] Inventor: Tadashi Ito, Kanagawa, Japan

[73] Assignee: Fuji Photo Film Co., Ltd., Kanagawa, Japan

[21] Appl. No.: 711,997

[22] Filed: Sep. 10, 1996

Related U.S. Application Data

[63] Continuation of Ser. No. 498,888, Jul. 6, 1995, abandoned.

[30] Foreign Application Priority Data

Jul. 6, 1994 [JP] Japan ..... 6-154776

[51] Int. Cl.[6] ..... G03C 5/31

[52] U.S. Cl. ..... 430/399; 430/440; 430/446; 430/488

[58] Field of Search ..... 430/399, 440, 430/446, 488

[56] References Cited

U.S. PATENT DOCUMENTS

| | | | |
|---|---|---|---|
| 4,605,609 | 8/1986 | Okazaki et al. | 430/642 |
| 5,004,669 | 4/1991 | Yamada et al. | 430/627 |
| 5,264,323 | 11/1993 | Purol et al. | 430/440 |
| 5,278,035 | 1/1994 | Knapp | 430/441 |
| 5,364,746 | 11/1994 | Inoue et al. | 430/488 |
| 5,441,847 | 8/1995 | Fukawa et al. | 430/264 |
| 5,457,009 | 10/1995 | Toyoda et al. | 430/488 |
| 5,510,231 | 4/1996 | Komatsu et al. | 430/488 |

*Primary Examiner*—Hoa Van Le

*Attorney, Agent, or Firm*—Sughrue, Mion, Zinn, Macpeak & Seas, PLLC

[57] ABSTRACT

A silver halide photographic material comprising a photographic material constituting layer, which is processed with a developer containing as a developing agent a reductone represented by formula (I)

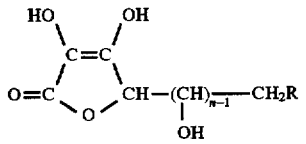

(I)

wherein

R represents a hydrogen atom or a hydroxyl group, and n represents an integer of from 1 to 4, wherein the photographic material constituting layer contains a calcium compound in an amount of not more than 10 $mg/m^2$ of the photographic material in terms of calcium.

11 Claims, No Drawings

SILVER HALIDE PHOTOGRAPHIC MATERIAL AND THE METHOD OF PROCESSING THE SAME

This is a Continuation of application Ser. No. 08/498,888 filed Jul. 6, 1995, now abandoned.

FIELD OF THE INVENTION

The present invention relates to a silver halide photographic material and a method for processing the same and, more particularly, to a silver halide photographic material which causes less contamination of a developing solution when processed with a developing solution having reductones, which are easy to handle and chemically safe, as a developing agent particularly when the replenishment rate of the developing solution is reduced, and a method for processing the silver halide photographic material.

BACKGROUND OF THE INVENTION

Photographic processing of a silver halide photographic material by an automatic processor is, in general, carried out by the combination of a process using a processing solution having a function of, respectively, development, fixing or washing. When a large amount of photographic materials are processed, replenishment is carried out to compensate for the composition of the solution consumed by processing or the composition reduced by taking out with being contained in the film of the photographic material. On the other hand, at the same time with the replenishment, a part of the processing solution is discarded as an overflow to remove the composition of the photographic material dissolved out into the processing solution by processing or the composition concentrated by evaporation (for example, a halogen ion in the developing solution and a silver complex salt in the fixing solution).

The usual photographic waste solution contains compositions harmful for the environmental protection, not desirable from the pollution problem and evacuation to a general drainage system is impossible, accordingly, disposal as the industrial waste is necessary. Therefore, those who must dispose such photographic waste solution (for example, hospitals, printing companies, mili-labs) have the special trades of waste solution disposal collect the solution by paying the collecting charges, or must install anti-pollution devices. The way of entrusting the trades with the waste solution disposal necessitates a reservoir for receiving the waste solution taking up a considerable space and a cost load is large. Also, the installation of the anti-pollution equipments has the drawbacks such that an extremely big initial equipment investment and a considerable site for the installation are necessary.

Further, as the ocean disposal principle inhibition of the industrial waste coming into effect in 1996 has been decided, the development of methods of fundamentally reducing the amount of the waste solution or means of effective disposal, not the only problem of the waste solution recovery in each institution, has been urgently demanded.

On the other hand, for the necessity of low pollution developing and fixing solutions, that is, the reduction or the removal of the compositions harmful for the environment has been increased. Particularly, the developing solution which is high in safety and does not become dark brown tarry when oxidized and easy to handle has been desired.

SUMMARY OF THE INVENTION

An object of the present invention is to provide a silver halide photographic material which causes less contamination of a developing solution when processed with a development processing solution having reductones, which are high in safety and easy to handle, as a developing agent particularly when the replenishment rate of the developing solution is reduced, and the method for processing the silver halide photographic material.

The above described object of the present invention has been attained by a silver halide photographic material containing a photographic material constituting layer, which is development processed with a development processing solution containing the reductones represented by formula (I) as a developing agent, wherein the photographic material constituting layer contains a calcium compound in an amount of not more than 10 mg/m$^2$ of the photographic material in terms of calcium.

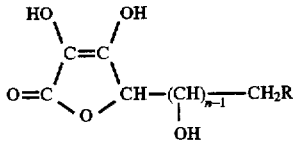

(I)

wherein

R represents a hydrogen atom or a hydroxyl group; and n represents an integer of from 1 to 4.

In the present specification, the photographic material constituting layer indicates all the layers constituting the photographic material, such as silver halide emulsion layer, protective layer, antihalation layer, interlayer, backing layer, back protective layer and subbing layer.

The developing agent for use in the development processing solution of the present invention is necessary to be reductones as the developing solution have to be high in developing activity, chemically safe, and easy to handle as it becomes a yellow crystal, not dark brown tarry as usual polyhydroxybenzenes when oxidized and dehydrated.

The types of reductones generally known as compounds which are used in the developing solution of the present invention include an Endiol type, an Enaminol type, an Endiamin type, a Thiol-Enol type and an Enamin-Thiol type. Examples of the compounds thereof are disclosed in U.S. Pat. No. 2,688,549 and JP-A-62-237443 (the term "JP-A" as used herein refers to a "published unexamined Japanese patent application"). The synthesis methods are also well known and disclosed in, for example, Tsugio Nomura and Hirohisa Ohmura, *Reductone no Kagaku* (*The Chemistry of Reductones*), published by Uchida-Rhokakuho Shinsha in 1969.

Preferred examples of the reductones for use in the present invention are shown below.

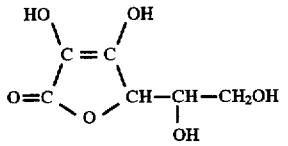

I-I

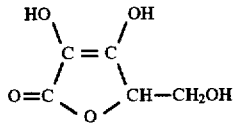

I-2

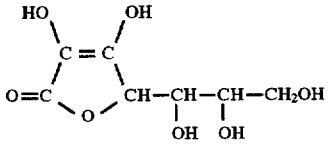

I-3

-continued

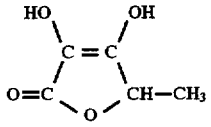

I-4

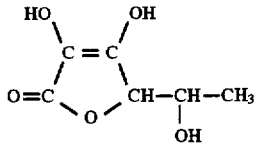

I-5

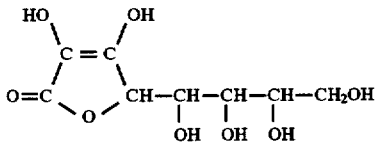

I-6

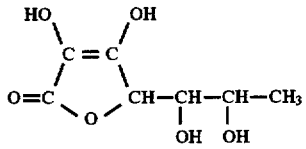

I-7

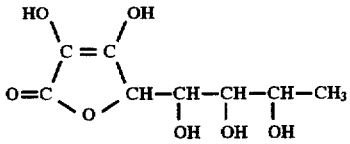

I-8

The reductones for use in the present invention may be used in the form of an alkali metal salt such as a lithium salt, a sodium salt and a potassium salt. These reductones are used in an amount of from 1 to 100 g and preferably from 5 to 80 g per liter of the developing solution.

The developing solution containing the reductones represented by formula (I) of the present invention preferably contains a 3-pyrazolidone compound represented by formula (II).

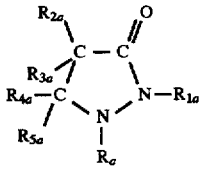

(II)

wherein $R_{1a}$, $R_{2a}$, $R_{3a}$, $R_{4a}$ and $R_{5a}$ are the same or different, and each represents a hydrogen atom; an alkyl group having from 1 to 4 carbon atoms, which may be substituted; an aryl group which may be substituted; or an aralkyl group which may be substituted.

Examples of the 3-pyrazolidone compounds for use in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

The 3-pyrazolidone compounds are preferably used in an amount of from 0.001 mol/liter to 1.2 mol/liter.

An ascorbic acid or an erytholbic acid which is the optical isomer thereof is most excellent of the particularly preferred reductones for use in the present invention.

The developing solution containing these reductones preferably contains 0.2 mol/liter or more and less than 0.8 mol/liter of carbonate. It is preferred for the developing solution containing an ascorbic acid or an erytholbic acid to contain 0.3 mol/liter or more and less than 0.6 mol/liter of carbonate for reducing the waste solution.

The compound represented by formula (III) or (IV) is preferably used in the developing solution of the present invention as a silver stain preventing agent for attaining the reduction of the replenishment rate.

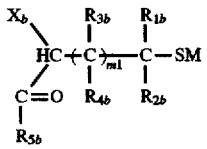

(III)

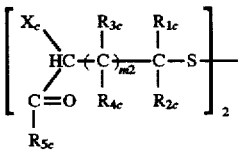

(IV)

wherein $R_{1b}$, $R_{2b}$, $R_{1c}$ and $R_{2c}$ each represents a hydrogen atom or an alkyl group having from 1 to 3 carbon atoms or a phenyl group; $R_{3b}$, $R_{4b}$, $R_{3c}$ and $R_{4c}$ each represents a hydrogen atom or an alkyl group having from 1 to 3 carbon atoms; $m_1$ and $m_2$ each represents 0, 1 or 2; $R_{5b}$ and $R_{5c}$ each represents a hydroxyl group, an amino group or an alkyl group having from 1 to 3 carbon atoms; M represents a hydrogen atom, an alkali metal atom or an ammonium group; and $X_b$ and $X_c$ each represents a hydrogen atom, an alkyl group having from 1 to 3 carbon atoms, a sulfonyl group, an amino group, an acylamino group, a dimethylamino group, an alkylsulfonylamino group or an arylsulfonylamino group.

Preferred examples of the compounds represented by formula (III) are shown below.

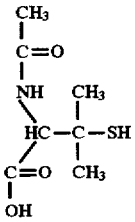

III-1

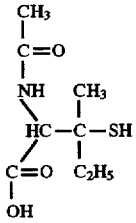

III- 2

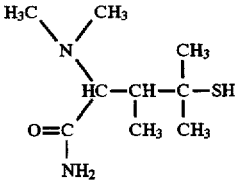

III-3

-continued

III-4

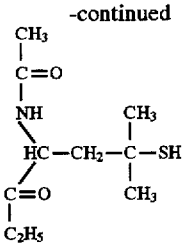

III-5

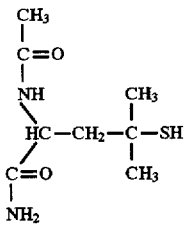

III-6

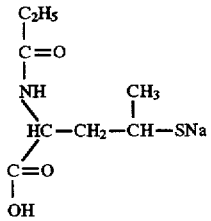

III-7

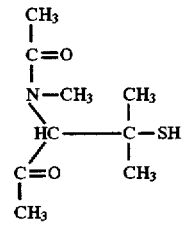

Preferred examples of the compounds represented by formula (IV) are shown below.

IV-1

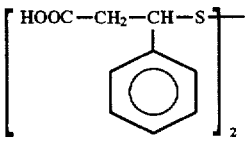

IV-2

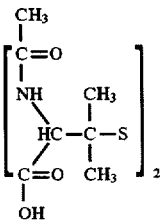

IV-4

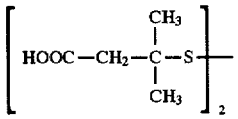

The concentration of the compounds represented by formulae (III) and (IV) in the developing solution (the solution usable as it is) is preferably from 0.01 mmol to 50 mmol/liter, more preferably from 0.05 mmol to 10 mmol/liter, and particularly preferably from 0.1 mmol to 5 mmol/liter.

The compounds represented by formulae (V) and (VI) can also be used as a silver stain preventing agent in the present invention.

(V)

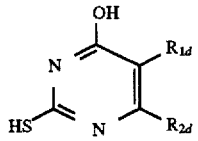

wherein $R_{1d}$ and $R_{2d}$ each represents a hydrogen atom, an alkyl group, an aryl group, an aralkyl group, a hydroxyl group, a mercapto group, a carboxyl group, a sulfo group, a phosphono group, a nitro group, a cyano group, a halogen atom, an alkoxycarbonyl group, an aryloxycarbonyl group, a carbamoyl group, a sulfamoyl group or an alkoxy group; the sum total of the carbon atom number of $R_1$ and $R_2$ is from 2 to 20, and $R_1$ and $R_2$ may be linked together to form a saturated cyclic structure.

(VI)

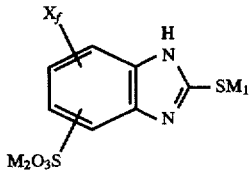

wherein $X_f$ represents a hydrogen atom or a sulfonic acid group; $M_1$ represents a hydrogen atom or an alkali metal atom; and $M_2$ represents a hydrogen atom, an alkali metal atom or an ammonium group.

Specific examples of the compounds represented by formula (V) for use in the present invention are shown below, but the present invention is not limited thereto.

V-1

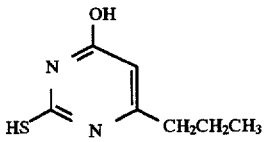

V-2

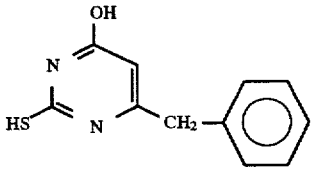

V-3

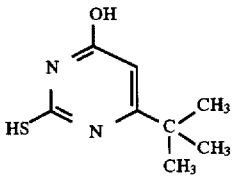

V-4

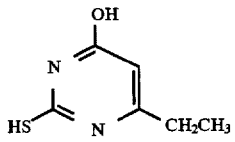

V-5

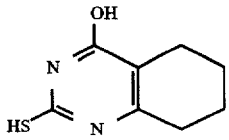

-continued

V-6

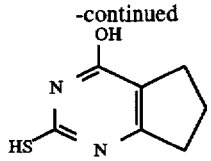

V-7

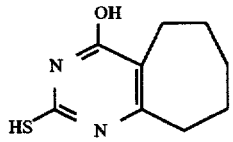

V-9

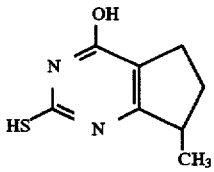

Specific examples of the compounds represented by formula (VI) of the present invention are shown below, but the present invention is not limited thereto.

VI-1

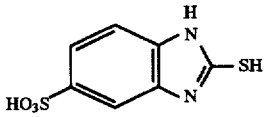

VI-2

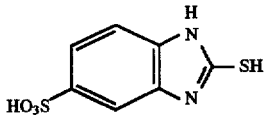

The concentration of the compounds represented by formulae (V) and (VI) in the developing solution (the working solution) is preferably from 0.01 mmol to 50 mmol/liter, more preferably from 0.05 mmol to 10 mmol/liter, and particularly preferably from 0.1 mmol to 5 mmol/liter.

The most effective method of using the silver stain preventing agent for use in the present invention is to use the compound represented by formula (III) or (IV) in combination with the compound represented by formula (V) or (VI). The ratio of the addition amount (mol/liter) of the compound represented by formula (III) or (IV) to the addition amount (mol/liter) of the compound represented by formula (V) or (VI) in the developing solution (the working solution) is from 100/1 to 1/1, preferably from 50/1 to 2/1, and particularly preferably from 30/1 to 5/1. The concentration of the compounds represented by formulae (III) to (VI) in the developing solution (the working solution) is preferably from 0.05 to 10 mmol/liter, particularly preferably from 0.1 to 5 mmol/liter, as total amount.

The developing solution for use in the present invention may contain an amino compound as a development accelerator. The amino compounds disclosed in JP-A-50-106244, JP-A-61-167759 and JP-A-2-208652 are particularly preferred as such amino compounds.

The developing solution for use in the present invention may contain a development inhibitor such as potassium bromide and potassium iodide; an organic solvent such as dimethylformamide, methyl cellosolve, hexylene glycol, ethanol and methanol; a benzotriazole derivative such as 5-methylbenzotriazole, 5-bromobenzotriazole, 5-chlorobenzotriazole, 5-butylbenzotriazole and benzotriazole, particularly preferably 5-methylbenzotriazole; and nitroindazole such as 5-nitroindazole, 6-nitroindazole, 4-nitroindazole, 7-nitroindazole and 3-cyano-5-nitroindazole, particularly preferably 5-nitroindazole.

A color toning agent, a surfactant, a water softener, and a hardening agent may be contained, if necessary.

A chelating agent for use in the developing solution of the present invention include, for example, ethylenediaminedorthohydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, 1,3-diaminopropanoltetraacetic acid, triethylenetetraminehexaacetic acid, transcyclohexanediaminetetraacetic acid, ethylenediaminetetraacetic acid, glycol ether diaminetetraacetic acid, ethylenediaminetetrakismethylenephosphonic acid, diethylenetriaminepentamethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,3,3-tricarboxylic acid, catechol-3,4-disulfonic acid, sodium pyrophosphate, sodium tetrapolyphosphate, and sodium hexametaphosphate, and particularly preferably diethylenetriaminepentaacetic acid, triethylenetetraminehexaacetic acid, 1,3-diaminopropanoltetraacetic acid, glycol ether diaminetetraacetic acid, hydroxyethylethylenediaminetriacetic acid, 2-phosphonobutane-1,2,4-tricarboxylic acid, 1,1-diphosphonoethane-2-carboxylic acid, nitrilotrimethylenephosphonic acid, ethylenediaminetetraphosphonic acid, diethylenetriaminepentaphosphonic acid, 1-hydroxypropylidene-1, 1-diphosphonic acid, 1-aminoethylidene-1,1-diphosphonic acid, 1-hydroxyethylidene-1,1-diphosphonic acid and salts of these compounds.

The developing solution for use in the present invention preferably has a pH of from 8.5 to 11, more preferably from 9 to 10.5.

An alkali agent which may be used for setting pH contains a pH adjusting agent such as sodium hydroxide, potassium hydroxide, sodium carbonate, potassium carbonate, sodium tertiary phosphate, and potassium tertiary phosphate. In addition to these, pH buffers as disclosed in JP-A-60-93433 may be used.

The pH buffer action by carbonate as disclosed in U.S. Pat. No. 5,236,816 is particularly useful and it is preferred in the present invention to contain carbonate in an amount of 0.2 mol/liter or more and less than 0.8 mol/liter, particularly 0.3 mol/liter or more and less than 0.5 mol/liter.

As a sulfite preservative for use in the developing solution of the present invention, there are enumerated sodium sulfite, potassium sulfite, lithium sulfite, ammonium sulfite, sodium bisulfite, and potassium metabisulfite. The sulfite is preferably used in an amount of 0.01 mol/liter or more and particularly preferably 0.02 mol/liter or more, and the upper limit is preferably up to 2.5 mol/liter.

In addition to them, those disclosed in L.F.A. Mason, *Photographic Processing Chemistry*, Focal Press (1966), pages 226 to 229, U.S. Pat. Nos. 2,193,015, 2,592,364, and JP-A-48-64933 may also be used.

Generally, boron compounds (for example, boric acid or borax) are often used as a pH buffer in a developing solution, but the developing solution containing reductones for use in the present invention preferably substantially does not contain boron compounds. The phrase "the developing solution substantially does not contain boron compounds" means that the developing solution does not contain boron compounds when adjusting thereof. That is, the boron compounds which may be dissolved out from the photographic material to be accumulated in the developing solution are excluded in this case.

The replenishment rate of the developing solution for use in the present invention is preferably less than 100 cc per $m^2$ of the photographic material and more preferably from no replenishment to 75 cc per $m^2$ from the viewpoint of environmental problem.

Sodium thiosulfate is preferred as a fixing agent considering the environmental problem. The amount of the fixing agent can be varied arbitrarily. The fixing solution preferably does not contain a water-soluble aluminum salt which acts as a hardening agent.

The fixing solution may contain a tartaric acid, a citric acid, a gluconic acid, a maleic acid or derivatives of them alone or in combination of two or more.

The methods disclosed in JP-A-1-4739 and JP-A-3-101728 can be used in the present invention for accelerating fixation.

The pH of the fixing solution of the present invention when processing the photographic material is preferably from 5.0 to 6.5, and more preferably from 5.2 to 6.2. Particularly, at pH 5.0 or more, there is no odor of sulfite used in the fixing solution, therefore, it is desirable for working conditions.

The replenishment rate of the fixing solution is preferably, the same as the developing solution, less than 100 cc per $m^2$ of the photographic material and more preferably from no replenishment to 75 cc per $m^2$.

The calcium compounds contained in the photographic material constituting layer of the photographic material of the present invention means all the calcium existing in the forms of an ion, a salt, a complex salt and the like, and suppressing these to 10 mg/$m^2$ or less as calcium contributes to exhibit the effect of the present invention, preferably 7.5 mg/$m^2$ or less and particularly preferably 5 mg/$m^2$ or less.

The determination of the calcium contained in the photographic material constituting layer of the photographic material is preferably carried out by fluorescent X-ray analysis.

A considerable amount of a calcium salt (for example, from 3,000 to 8,000 ppm) originating in a calcium phosphate constituting a cattle bone, a raw material of gelatin, is contained in gelatin used as a binder in a silver halide photographic material. The amount differs depending on the kinds of raw materials, and various methods of processing such as deliming.

The problem of the contamination of a developing solution when development processing the photographic material with the developing solution containing the developing agent represented by formula (I), particularly in low replenishment rate, can be solved by absolutely unexpected method of the present invention by suppressing the amount of the calcium compound contained in such a wide range in the photographic material constituting layer to 10 mg/$m^2$ or less as a calcium amount.

The disclosure concerning the regulation on the content of calcium in a photographic material is found in JP-A-60-159850 but this relates to specific magenta couplers concerning the prevention of the fluctuation of photographic performances in continuous processing, and the disclosure in JP-A-64-86141 concerns the turbidity of the water in the washing tank and the prevention of growing of mold. In addition to the above, there are disclosures in JP-A-64-73337 and JP-A-1-303438, but these relates to developing solutions using p-phenylenediamine color developing agents or dihydroxybenzenes which are representative black-and-white developing agents.

The present invention is different from the above patents in the point of using reductones represented by formula (I) as a developing agent. It was found that the oxidation products produced by development processing the photographic material with the reductones represented by formula (I) or produced by air oxidation react with the calcium in the photographic material and as a result the developing solution becomes white turbid singularly leading to the present invention. This is in this point a peculiar phenomenon to the compound represented by formula (I) and does not occur by p-phenylenediamine compounds or dihydroxybenzenes.

The calcium content in a photographic material is in general, for example, in a medical X-ray photographic material, from 15 mg/$m^2$ to 20 mg/$m^2$ or more.

The method of rectifying the calcium content in the photographic material constituting layer of the silver halide photographic material in executing the present invention includes the following methods.

(1) The method of using a raw material gelatin having a small calcium content when producing the photographic material (2) The method of previously desalting the additives containing gelatin such as a gelatin solution, an emulsified product, a silver halide emulsion, etc., by noodle washing or dialysis when producing the photographic material The method (1) is preferred of the above from the point of the stability of the performance of the photographic material. The content of calcium in gelatin is 2,000 ppm or more in lime-processed gelatin and 1,000 ppm or more in acid-processed gelatin, but deionized gelatin having a low calcium content (100 ppm or less) can be obtained by processing with an $Na^+$ type or $H^+$ type cation exchange resin.

Further, low calcium content gelatin obtained by any process such as dialysis process, etc., may preferably be used in the present invention.

The silver halide emulsions preferably used in the photographic material of the present invention are silver chlorobromide and silver chloroiodobromide from the point of fixability, particularly those having the average silver chloride content of 80 mol % or more and less than 100 mol %, more preferably 90 mol % or more and less than 99 mol %. In addition, the silver iodide content in silver chloroiodobromide emulsion is preferably not exceeding 1 mol %, and particularly preferably 0.5 mol % or less.

The silver halide grains may have a regular crystal form such as a cubic or octahedral form, an irregular crystal form such as a spherical, tabular or potato-like form, or a form which is a composite of various crystal forms.

Monodisperse emulsions are preferably used in the present invention. The producing method of monodisperse emulsions are well known and can be prepared, for example, using the methods disclosed in *J. Photo. Sci.*, 12, pp. 242 to 251 (1963), JP-B-48-36890, JP-B-52-16364 (the term "JP-B" as used herein refers to an "examined Japanese patent publication"), JP-A-55-142329 and JP-A-57-179835.

The emulsion for use in the present invention may be core/shell type emulsions. Core/shell type emulsion are well known according to JP-A-54-48521 and the like.

With respect to tabular grains, *Research Disclosure*, Vol. 225, Item 22534, pp. 20 to 58, (January, 1983), JP-A-58-127921, JP-A-58-113926, JP-A-58-113927, JP-A-58-113928 and U.S. Pat. No. 4,439,520 can be referred to.

With respect to silver chlorobromide tabular grain emulsions, emulsions having a (111) major face as a crystal habit and emulsions having a (100) major face are known. The silver chlorobromide tabular grain emulsions having a (111) face are disclosed in JP-B-64-8325, JP-B-64-8326, JP-A-62-111936 and JP-A-62-163046.

On the other hand, (100) face silver chlorobromide tabular emulsions are disclosed in JP-A-51-88017, JP-B-64-8323, and EP 0,534,395A1. Further, the techniques disclosed in Japanese Patent Application Nos. 5-287226 and 5-271057 are particularly preferred for the reasons that the grain size distribution is narrow and high sensitive grains can be obtained.

Water-soluble iridium compounds may be used in the silver halide grains for use in the present invention. For example, an iridium(III) halide compound, an iridium(IV) halide compound, an iridium complex salt having halogen, amines, oxalate as a ligand, for example, a hexachloroiridium(III) or (IV) complex salt, a hexaammineiridium (III) or (IV) complex salt, a trioxalatoiridium(III) or (IV) salt may be enumerated. The trivalent compound and the tetravalent compound selected from these compounds may be used in arbitrary combination. These iridium compounds are used by dissolving in water or an appropriate solvent, but the method which is generally conducted to stabilize the solution of iridium compound, that is, the method of adding an aqueous solution of halogenated hydrogen (e.g., hydrochloric acid, hydrobromic acid, hydrofluoric acid), or alkali halide (e.g., KCl, NaCl, KBr, NaBr) may be used. It is also possible to dissolve iridium compounds by adding other silver halide grains previously doped with iridium during silver halide grain preparation instead of using water-soluble iridium compounds.

The total addition amount of the iridium compounds for use in the present invention is $10^{-8}$ mol or more, preferably from $1\times10^{-8}$ to $1\times10^{-5}$ mol, and most preferably from $5\times10^{-8}$ to $5\times10^{-6}$ mol, per mol of the finally formed silver halide grains.

The addition of these compounds can be conducted at appropriate stages of during formation of the silver halide emulsion and before coating the emulsion, but they are preferably added during grain formation and included in the silver halide grains. Iridium compounds may be used in combination with the compounds containing the atoms belonging to VIII group other than iridium.

The total amount of gelatin coated on the silver halide emulsion layer side (the side on the support where the silver halide emulsion layer is present) of the photographic material of the present invention is preferably from 1.0 g/m$^2$ to 3.5 g/m$^2$, more preferably from 1.5 g/m$^2$ to 3.3 g/m$^2$, and further preferably from 1.8 g/m$^2$ to 3.0 g/m$^2$, for rapid processing.

The coating amount of silver of the silver halide emulsion per one side of the photographic material of the present invention is from 0.8 g/m$^2$ to 3.5 g/m$^2$, preferably from 1.0 g/m$^2$ to 3.2 g/m$^2$, more preferably from 1.2 g/m$^2$ to 3 g/m$^2$.

Further, the weight ratio of the silver to the gelatin in the silver halide emulsion layer is an important factor from the viewpoint of rapid processability. By raising the weight ratio of the silver to the gelatin in the silver halide emulsion layer, emulsion pick-off occurs when processing a silver halide photographic material by an automatic processor, that is, the silver halide photographic material peels off by the projection of the roller and, as a result, images become hard to see. From this point, the weight ratio of the silver to the gelatin in the silver halide emulsion layer is preferably from 0.5 to 1.8, more preferably from 0.7 to 1.6, and further preferably from 0.8 to 1.5.

The various additives described in the following corresponding places may be used in the photographic material of the present invention.

| Item | Places |
|---|---|
| 1) Method of chemical sensitization | line 13, right upper column, page 10 to line 16, left upper column of JP-A-2-68539; and Japanese Pat. App. No. 3-105035 |
| 2) Antifoggant and stabilizer | line 17, left lower column, page 10, to line 7, left upper column, page 11 of JP-A-2-68539; and line 2, left lower column, page 3 to left lower column, page 4 of JP-A-2-68539 |
| 3) Tone improving agent | line 7, left lower column, page 2 to line 20, left lower column, page 10 of JP-A-62-276539; and line 15, left lower column, page 6 to line 19, right upper column, page 11 of JP-A-3-94249 |
| 4) Surfactant and antistatic agent | line 14, left upper column, page 11 to line 9, left upper column, page 12 of JP-A-2-68539 |
| 5) Matting agent, sliding agent and plasticizer | line 10, left upper column, page 12 to line 10, right upper column, page 12 of JP-A-2-68539; and line 10, left lower column, page 14 to line 1, right lower column, page 14 of JP-A-2-68539 |
| 6) Hydrophilic colloid | line 11, right upper column, page 12 to line 16, left lower column, page 12 of JP-A-2-68539 |
| 7) Hardening agent | line 17, left lower column, page 12 to line 6, right upper column, page 13 of JP-A-3-39948 |
| 8) Polyhydroxybenzenes | left upper column, page 11 to left lower column, page 12 of JP-A-2-68539; and EP452,772A |
| 9) Spectral sensitizing dye | line 4, right lower column, page 4 to right lower column, page 8 of JP-A-2-68539; and JP-A-5-165136 |
| 10) Dye and mordant | line 1, left lower column, page 13 to line 9, left lower column, page 14 of JP-A-2-68539; and Japanese Pat. App. No. 5-153911 |
| 11) Support | right upper column, page 13 to line 20 of JP-A-2-68539 |
| 12) Form of package | JP-A-63-223747 and U.S. Pat. 4,915,229 |

The present invention is described in detail with reference to examples but the present invention is not limited thereto.

EXAMPLE 1

1. Preparation of Silver Halide Emulsion a) Preparation of Silver Halide Emulsion A After 20 g of gelatin was added to 800 ml of a distilled water and dissolved at 40° C., the pH of the solution was adjusted to 3.8 with a citric acid, then 3.2 g of sodium chloride and 0.5 ml of N,N-dimethylimidazoline-2-thione (a 1% aqueous solution) were added thereto. A solution of 100 g of silver nitrate dissolved in 314 ml of a distilled water, and a solution of 36.2 g of sodium chloride and $K_2IrCl_6$, in the amount to reach $10^{-6}$ mol per mol of the completed silver halide, dissolved in 314 ml of a distilled water were added to and mixed with the above described aqueous solution at 40° C. over 12 minutes.

Two minutes after, a solution of 60 g of silver nitrate dissolved in 186 ml of a distilled water and a solution of 21.5 g of sodium chloride dissolved in 186 ml of a distilled water were added and mixed at 40° C. over 9 minutes and 30 seconds to make a core part. Subsequently, a solution of 40 g of silver nitrate dissolved in 127 ml of a distilled water, and a solution of 11.9 g of sodium chloride, 5.7 g of potassium bromide, and $K_4Fe(CN)_6.3H_2O$, in the amount to reach $1\times10^{-5}$ mol per mol of the completed silver halide, dissolved in 127 ml of a distilled water were added and mixed to the above core part solution at 40° C. over 6 minutes and 30 seconds to make a shell.

The obtained emulsion was observed by an electron microscope. The emulsion comprised a cubic grains having a grain size corresponding to the circle of a projected area of 0.2 μm and variation coefficient of 10%.

After desalting processing that emulsion, 100 g of gelatin, 100 mg of Proxel, 1.7 g of phenoxyethanol and 0.15 g of a nucleic acid were added and pH was adjusted to 6.2 and pAg was adjusted to 7.7 with sodium chloride and chemical sensitization was carried out at 60° C. as follows.

At first, 0.2 g of potassium iodide was added, and 10 minutes after 13.3 mg of sodium thiosulfate was added, further 5 minutes after 18.9 mg of chloroauric acid was added and ripened for 60 minutes, then quickly cooled and solidified the emulsion with adding 0.38 g of 4-hydroxy-6-methyl-1,3,3a,7-tetraazaindene to obtain Emulsion A.

Emulsion A was silver chloroiodobromide having a silver chloride content of 95.8 mol %, a silver bromide content of 4.1 mol % and a silver iodide content of 0.1 mol %.

The calcium content in the gelatin used was rectified to become the amount as shown in Table 1.

2. Preparation of Emulsion Coating Solution

The emulsion coating solution was prepared by adding the chemicals shown below to Emulsion A per mol of the silver halide.

| | | |
|---|---|---|
| a. | Gelatin (the amount of calcium is indicated in Table 1) | 100 g |
| b. | Polyacrylamide (molecular weight: 40,000) | 8.7 g |
| c. | Sodium Polystyrenesulfonate (molecular weight: 600,000) | 0.8 g |
| d. | Polymethyl Methacrylate Fine Particles | |
| | (average particle size: 2.5 μm) | 2.7 g |
| | (average particle size: 0.8 μm) | 9.2 g |
| e. | Sodium Polyacrylate | 2.6 g |
| f. | Sodium t-Octylphenoxyethoxyethanesulfonate | 1.6 g |
| g. | $C_{16}H_{33}O-(CH_2CH_2O)_{10}-H$ | 3.6 g |
| h. | $C_8F_{17}SO_3K$ | 176 mg |
| i. | $C_8F_{17}SO_2N(C_3H_7)(CH_2CH_2O)_4(CH_2)_4-SO_3Na$ | 88 mg |
| j. | NaOH | 0.2 g |
| k. | Methanol | 83 cc |

Prescription of Emulsion Coating Solution a. Spectral Sensitizing Dye [1] — $7.3 \times 10^{-5}$ mol

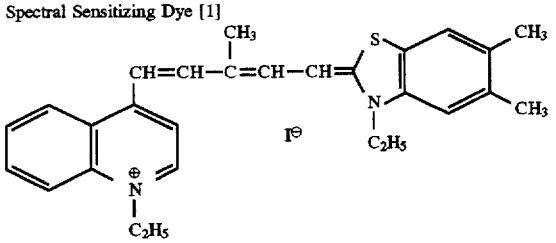

b. Supersensitizer [2] — 0.42 g

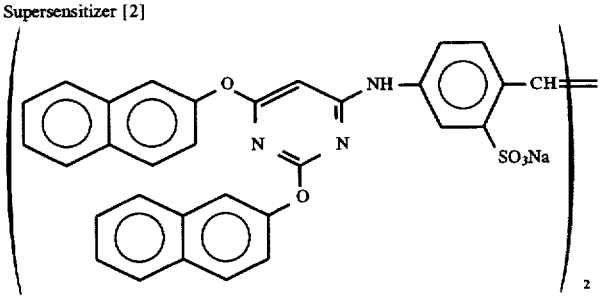

| | | |
|---|---|---|
| c. | Polyacrylamide (molecular weight: 40,000) | 9.2 g |
| d. | Trimethylolpropane | 1.4 g |
| e. | Latex of Poly(ethyl acrylate/acrylic acid = 95/5) | 20 g |
| f. | Compound (3) | 0.38 g |

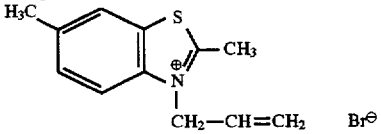

g. Compound (4) — 0.085 g

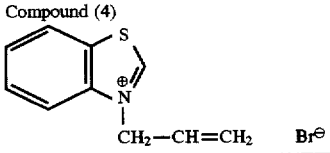

3. Preparation of Surface Protective Layer Coating Solution for Emulsion Layer

The following chemicals were added to a vessel heated to 40° C. and the coating solution was prepared.

-continued

| | | |
|---|---|---|
| l. | 1,2-Bis(vinylsulfonylacetamido)ethane | adjusted to be 2.5 wt % based on the total amount of gelatin of the emulsion |

-continued

| | | |
|---|---|---|
| | | layer and the surface protective layer |
| m. | Compound (5) | 56 mg |

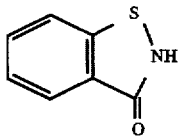

4. Preparation of Backing Layer Coating Solution

The following chemicals were added to a vessel heated to 40° C. and the backing layer coating solution was prepared.

| | | |
|---|---|---|
| a. | Gelatin (the amount of calcium is indicated in Table 1) | 100 g |
| b. | Dye (A) | 2.1 g |

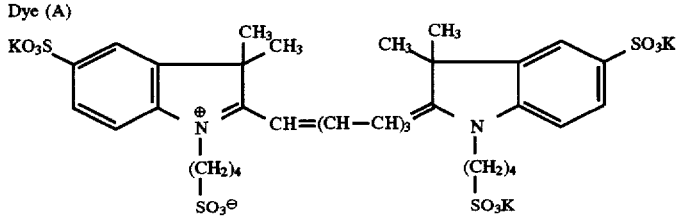

| | | |
|---|---|---|
| c. | Sodium Polystyrenesulfonate | 1.26 g |
| d. | Phosphoric Acid | 0.4 g |
| e. | Latex of Poly(ethyl acrylate/acrylic acid = 95/5) | 2.2 g |
| f. | Compound (5) | 42 mg |

Preparation of Dye Dispersion L

A solution of the following Dye-I, Oil-I and Oil-II, each in an amount of 2.5 g, dissolved in 50 cc of ethyl acetate, and 90 g of an 8% aqueous solution of gelatin containing 1.5 g of sodium dodecylbenzenesulfonate and 0.18 g of methyl p-hydroxybenzoate were mixed at 60° C. and agitated at high speed using a homogenizer. After completion of high speed agitation, the reaction mixture was processed under reduced pressure by evaporator at 60° C., and 92 wt % of the ethyl acetate was removed to thereby obtain Dye Dispersion L having an average grain size of 0.18 μm.

Dye-I

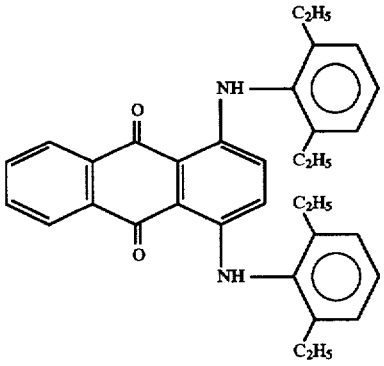

Oil-I

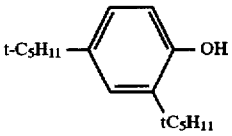

-continued

Oil-II

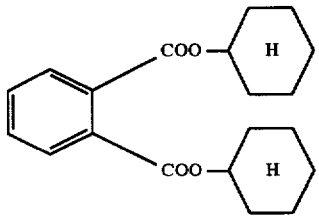

| | | |
|---|---|---|
| g. | Dye Dispersion L | 18.7 g |
| h. | Oil Dispersion of Dye (B) in JP-A-61-285445 as Dye Itself | 65 mg |

Dye(B)

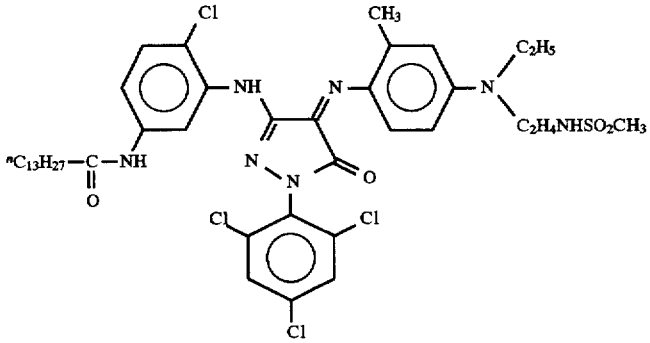

| | | |
|---|---|---|
| i. | Compound (6) | 0.65 g |

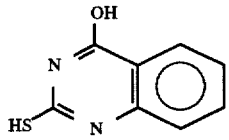

| | | |
|---|---|---|
| j. | Compound (7) | 0.55 g |

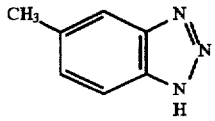

5. Preparation of Surface Protective Layer Coating Solution for Backing Layer

The following chemicals were added to a vessel heated to 40° C. and the coating solution was prepared.

| | |
|---|---|
| a. Gelatin (the amount of calcium is indicated in Table 1) | 100 g |
| c. Sodium Polystyrenesulfonate | 0.78 g |
| c. Polymethyl Methacrylate Fine Particles (average particle size: 4.7 μm) | 3.1 g |
| d. Sodium t-Octylphenoxyethoxyethane-sulfonate | 2 g |
| e. Sodium Polyacrylate | 1.8 g |
| f. $C_{16}H_{33}O—(CH_2CH_2O)_{10}—H$ | 4.05 g |
| g. $C_8F_{17}SO_3K$ | 396 mg |
| h. $C_8F_{17}SO_2N(C_3H_7)(CH_2CH_2O)_4(CH_2)_4—SO_3Na$ | 52 mg |
| i. NaOH | 0.24 g |
| j. Methanol | 148 ml |

-continued

| | |
|---|---|
| k. 1,2-Bis(vinylsulfonylacetamido)ethane | adjusted to be 2.5 wt % based on the total amount of gelatin of the backing layer and the surface protective layer |
| l. Compound (5) | 52.5 mg |

6. Preparation of Photographic Material

The above backing layer coating solution was coated on one side of the blue colored polyethylene terephthalate support together with the surface protective layer coating solution for the backing layer so that the coating amount of gelatin of the backing layer became 2.30 g/m$^2$ and the coating amount of gelatin of the surface protective layer for the backing layer became 1.02 g/m$^2$.

Subsequently, the above described emulsion coating solution and the surface protective layer coating solution were coated on the opposite side of the support so that the coating amount of silver, the coating amount of gelatin of the emulsion layer and the coating amount of gelatin of the surface protective layer became 1.95 g/m$^2$, 1.7 g/m$^2$ and 1.09 g/m$^2$, respectively. Thus, Photographic Materials 1 to 5 differing in the calcium contents of gelatin as indicated in Table 1 were prepared. The calcium content was determined by fluorescent X-ray analysis.

7. Processing Conditions of Photographic Material

The developing solution and the fixing solution were prepared as follows, and the running conditions are also shown below.

(1) Preparation of Developing Solution

| | |
|---|---|
| Diethylenetriaminepentaacetic Acid | 4 g |
| $Na_2CO_3$ | 42.4 g |
| Sodium Sulfite | 30 g |
| Ascorbic Acid | 50 g |
| KBr | 0.5 g |
| 5-Methylbenzotriazole | 0.06 g |
| 4-Methyl-4-hydroxymethyl-1-phenyl-3-pyrazolidone | 6 g |
| 2,3,5,6,7,8-Hexahydro-2-thioxo-4(1H)-quinazoline | 0.128 g |
| Water to make | 1 liter |
| pH adjusted to 9.7 | |

(2) Preparation of Fixing Solution

| | |
|---|---|
| Ethylenediaminetetraacetic Acid | 0.025 g |
| Sodium Thiosulfate | 290 g |
| Sodium Bisulfite | 76 g |
| NaOH | 2.4 g |
| Water to make the total amount | 1 liter |
| pH was adjusted to 5.6 | |

(3) Running Conditions

Running processing was conducted according to the following running conditions using automatic processor Laser Imager FL-IMD (a product of Fuji Photo Film Co., Ltd.) and the above developing solution and fixing solution.

Processing speed of the processor.

Dry to dry: 40 seconds.

Developing tank: 35° C., tank capacity: 6 liters.

Fixing tank: 35° C., tank capacity: 5.8 liters.

Washing water amount: 3 liters per minute only when the photographic material is processed.

The following method was used to easily make equilibrium running conditions.

At first, Photographic Materials 1 to 5 were cut to a B4 size (0.257 m×0.364 m), images of blackening rate indicated in Table 1 were prepared and the above processing was carried out.

Processing of the number of sheets shown below was conducted without replenishing the developing solution and the fixing solution to easily make equilibrium running conditions and which were made the conditions corresponding to replenishment of the processing solutions.

When processed 300 sheets of B4 size: corresponding to replenishment of 214 cc/m$^2$ When processed 750 sheets of B4 size: corresponding to replenishment of 85.5 cc/m$^2$ When processed 1,200 sheets of B4 size: corresponding to replenishment of 53.4 cc/m$^2$ When processed 1,500 sheets of B4 size: corresponding to replenishment of 42.8 cc/m$^2$ In addition, the decrease of the amount of the developing solution by carry-over of the developing solution was 1.5 cc per one sheet of B4 size. This decrement was compensated for by the replenishment of 150 cc every processing of 100 sheets of B4 size, and the equilibrium conditions were recovered by further processing photographic materials by the replenished amount.

8. Evaluation of Contamination of Solution

The above photographic material was processed and the contamination of the solution was evaluated according to the following ranking at each equilibrium running condition corresponding to replenishment.

Ranking 1: The developing solution is white turbid and inside of the developing tank cannot be seen, and the stain adheres to the photographic material and affects the image.

Ranking 3: The developing solution is a little white turbid and practically not admittable.

Ranking 5: White turbidity is not present at all

Rankings 2 and 4 are each intermediate levels of up and down levels thereof. Practically admittable levels are ranking 4 and ranking 5.

The results obtained are shown in Table 1.

TABLE 1

| | Content of Calcium (mg/m$^2$) | | | Corresponding Replenishment Amount per m$^2$ | Blackening | Evaluation of |
|---|---|---|---|---|---|---|
| | Emulsion Layer Side | Backing Layer Side | Total Amount | of the Material (cc) | Rate (%) | Contamination of Solution |
| Material 1 (Comparison) | 9.5 | 11.2 | 20.7 | 53.4 | 30 | Ranking 3 |
| Material 1 (Comparison) | " | " | " | 42.8 | " | Ranking 1 |
| Material 1 (Comparison) | " | " | " | 214 | 80 | Ranking 3 |
| Material 1 (Comparison) | " | " | " | 85.5 | " | Ranking 1 |
| Material 2 (Comparison) | 9.5 | 6.3 | 15.8 | 42.8 | 30 | Ranking 3 |
| Material 2 (Comparison) | " | " | " | 85.5 | 80 | Ranking 2 |

TABLE 1-continued

| | Content of Calcium ($mg/m^2$) | | | Corresponding Replenishment Amount per $m^2$ | Blackening | Evaluation of |
|---|---|---|---|---|---|---|
| | Emulsion Layer Side | Backing Layer Side | Total Amount | of the Material (cc) | Rate (%) | Contamination of Solution |
| Material 3 (Invention) | 7.3 | 0.7 | 8.0 | 42.8 | 30 | Ranking 4 |
| Material 3 (Invention) | " | " | " | 85.5 | 80 | Ranking 4 |
| Material 3 (Invention) | " | " | " | 53.4 | 80 | Ranking 4 |
| Material 4 (Invention) | 0.6 | " | 1.3 | 42.8 | 30 | Ranking 5 |
| Material 4 (Invention) | " | " | " | 53.4 | 80 | Ranking 5 |
| Material 4 (Invention) | " | " | " | 42.8 | 80 | Ranking 5 |
| Material 5 (Invention) | 3.7 | " | 4.4 | 42.8 | 30 | Ranking 5 |
| Material 5 (Invention) | " | " | " | 42.8 | 80 | Ranking 4 |

It can be seen from Table 1 that when the calcium content is 10 mg or less per $m^2$ of the photographic material, contamination of the solution is in the level of almost no problem, and the effect is particularly conspicuous when the replenishment amount is reduced.

From the above fact, the present invention is apparently effective.

In addition, for reference, Photographic Materials 1 to 5 were processed similarly except for replacing the developing solution with the following solution. In this case, the white turbidity did not occur in any material. Accordingly, it can be understood that white turbidity of the developing solution occurs when the photographic material containing a large amount of calcium (10 $mg/m^2$ or more) is processed with the developing solution containing reductones (ascorbic acid and the like).

| Preparation of Developing Solution | |
|---|---|
| Potassium Hydroxide | 50 g |
| Diethylenetriaminepentaacetic Acid | 4 g |
| Potassium Carbonate | 70 g |
| Sodium Sulfite | 87.5 g |
| Potassium Sulfite | 110 g |
| Hydroquinone | 37.5 g |
| Diethylene Glycol | 50 g |
| 4-Hydroxymethyl-4-methyl-1-phenyl-3-pyrazolidone | 12.5 g |
| 5-Methylbenzotriazole | 0.06 g |
| 2,3,5,6,7,8-Hexahydro-2-thioxo-4(1H)-quinazoline | 0.27 g |
| Sodium 2-Mercaptobenzimidazole-5-sulfonate | 0.20 g |
| Potassium Bromide | 0.5 g |
| Water to make | 1 liter |
| pH (adjusted with potassium hydroxide) | 10.70 |

While the invention has been described in detail and with reference to specific examples thereof, it will be apparent to one skilled in the art that various changes and modifications can be made therein without departing from the spirit and scope thereof.

What is claimed is:

1. A process for processing a silver halide photographic material using an automatic processor, which comprises the steps of:

(i) developing the photographic material with a developer having a pH of from 9 to 10.5 and containing, as a developing agent, a reductone which is present in an amount of from 5 to 80 g per liter of said developer and which is represented by formula (I):

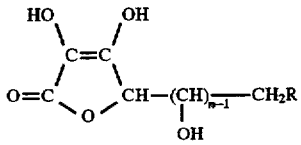

(I)

wherein R represents a hydrogen atom or a hydroxyl group, and n represents an integer of from 1 to 4;

(ii) fixing the developed material; and (iii) washing the fixed material, wherein the developer is replenished at a replenishment rate of 42.8 to 100 cc per $m^2$ of the photographic material; and wherein said photographic material comprises a photographic material constituting layer containing a calcium compound in a total amount of not more than 10 $mg/m^2$ and a support having provided thereon at least one silver halide emulsion layer.

2. The process for processing a silver halide photographic material using an automatic processor as claimed in claim 1, wherein said developer further comprises a 3-pyrazolidone compound represented by formula (II):

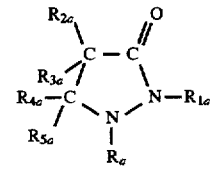

(II)

wherein $R_{1a}$, $R_{2a}$, $R_{3a}$, $R_{4a}$, and $R_{5a}$ are the same or different, and each represents a hydrogen atom; a substituted or unsubstituted alkyl group having from 1 to 4 carbon atoms; a substituted or unsubstituted aryl group; or a substituted or unsubstituted aralkyl group.

3. The process for processing a silver halide photographic material using an automatic processor as claimed in claim 2, wherein said 3-pyrazolidine compound represented by formula (II) is used in an amount of from 0.001 mol/liter to 1.2 mol/liter based on said developer.

4. The process for processing a silver halide photographic material using an automatic processor as claimed in claim 1, wherein said developer further contains carbonate in an amount of from 0.2 to 0.8 mol/l.

5. The process for processing a silver halide photographic material using an automatic processor as claimed in claim 1, wherein said developer further comprises a compound represented by formulae (III) or (IV):

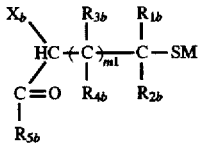

(III)

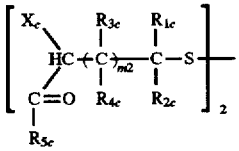

(IV)

wherein $R_{1b}$, $R_{2b}$, $R_{1c}$, and $R_{2c}$ each represents a hydrogen atom or an alkyl group having from 1 to 3 carbon atoms or a phenyl group; $R_{3b}$, $R_{4b}$, $R_{3c}$, and $R_{4c}$ each represents a hydrogen atom or an alkyl group having from 1 to 3 carbon atoms; $m_1$ and $m_2$ each represents 0, 1, or 2; $R_{5b}$ and $R_{5c}$ each represents a hydroxyl group, an amino group or an alkyl group having from i to 3 carbon atoms; M represents a hydrogen atom, an alkali metal atom or an ammonium group; and $X_b$ and $X_c$ each represents a hydrogen atom, an alkyl group having from 1 to 3 carbon atoms, a sulfonyl group, an amino group, an acylamino group, a dimethylamino group, an alkylsulfonylamino group or an arylsulfonylamino group.

6. The process for processing a silver halide photographic material using an automatic processor as claimed in claim 5, wherein said compound represented by formulae (III) or (IV) is present in said developer in amount of from 0.01 mmol to 50 mmol/l.

7. The process for processing a silver halide photographic material using an automatic processor as claimed in claim 1, wherein said developer further contains a compound represented by formulae (V) or (VI):

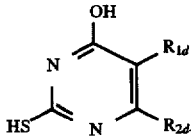

(V)

wherein $R_{1d}$ and $R_{2d}$ each represents a hydrogen atom, an alkyl group, an aryl group, an aralkyl group, a hydroxyl group, a mercapto group, a carboxyl group, a sulfo group, a phosphono group, a nitro group, a cyano group, a halogen atom, an alkoxycarbonyl group, an aryloxycarbonyl group, a carbamoyl group, a sulfamoyl group or an alkoxy group; the sum total of the carbon atom number of $R_1$ and $R_2$ is from 2 to 20, and $R_1$ and $R_2$ may be linked together to form a saturated cyclic structure;

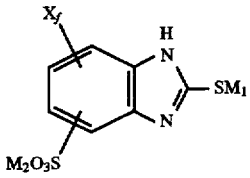

(VI)

wherein $X_f$ represents a hydrogen atom or a sulfonic acid group; $M_1$ represents a hydrogen atom or an alkali metal atom; and $M_2$ represents a hydrogen atom, an alkali metal atom or an ammonium group.

8. The process for processing a silver halide photographic material using an automatic processor as claimed in claim 7, wherein said compound represented by formula (V) or (VI) is present in said developer in an amount of from 0.01 to 50 mmol/l.

9. The process for processing a silver halide photographic material using an automatic processor as claimed in claim 1, wherein said replenishment rate of the developer is 75 cc/$m^2$ or less.

10. The process for processing a silver halide photographic material using an automatic processor as claimed in claim 1, wherein said calcium compound is present in said photographic material constituting layer in an amount of 7.5 mg/$m^2$ or less.

11. The process for processing a silver halide photographic material using an automatic processor as claimed in claim 1, wherein said calcium compound is present in said photographic material constituting layer in an amount of from 5 mg/$m^2$ or less.

* * * * *